United States Patent [19]

Simons et al.

[11] 4,282,413

[45] Aug. 4, 1981

[54] LIQUID FLOW INDICATOR

[75] Inventors: John R. Simons, Greendale; John W. Fenske, Wauwatosa, both of Wis.

[73] Assignee: Grunau Company, Inc., Milwaukee, Wis.

[21] Appl. No.: 54,299

[22] Filed: Jul. 2, 1979

[51] Int. Cl.[3] ..... H01H 35/40

[52] U.S. Cl. ..... 200/81.9 M; 340/610

[58] Field of Search ..... 200/81.9 R, 81.9 M, 200/61.04, 82 E; 335/205-207; 340/606, 610; 73/194 E, 228, 186

[56] References Cited

U.S. PATENT DOCUMENTS

| | | | |
|---|---|---|---|
| 2,038,111 | 4/1936 | Hopkins | 340/610 |
| 2,600,309 | 6/1952 | MacDonald | 200/81.9 M |
| 2,952,753 | 9/1960 | Kmiecik | 73/228 |

FOREIGN PATENT DOCUMENTS

| | | | |
|---|---|---|---|
| 237548 | 2/1962 | Australia | 340/610 |

*Primary Examiner*—Gerald P. Tolin

*Attorney, Agent, or Firm*—Andrus, Sceales, Starke & Sawall

[57] ABSTRACT

A liquid flow indicator for use in an automatic sprinkler system. The indicator is adapted to be attached to a water line and includes a non-metallic vane retainer or support which is mounted within an opening in the water line. A flexible one-piece plastic vane is pivoted to the retainer and has a generally circular body portion which is disposed transversely within the pipe. If the water line is opened downstream of the indicator, the flow of water within the line will pivot the vane, causing a magnet in the upper end of the vane to move into proximity with a sensor to complete an electrical circuit and generate a signal indicating that the water line has been opened. The retainer is formed with a pair of aligned recesses which are sealed apart by a central wall and the upper head of the vane which contains the magnet, is located in one recess, while the sensor is in the other recess.

8 Claims, 5 Drawing Figures

Fig. 3
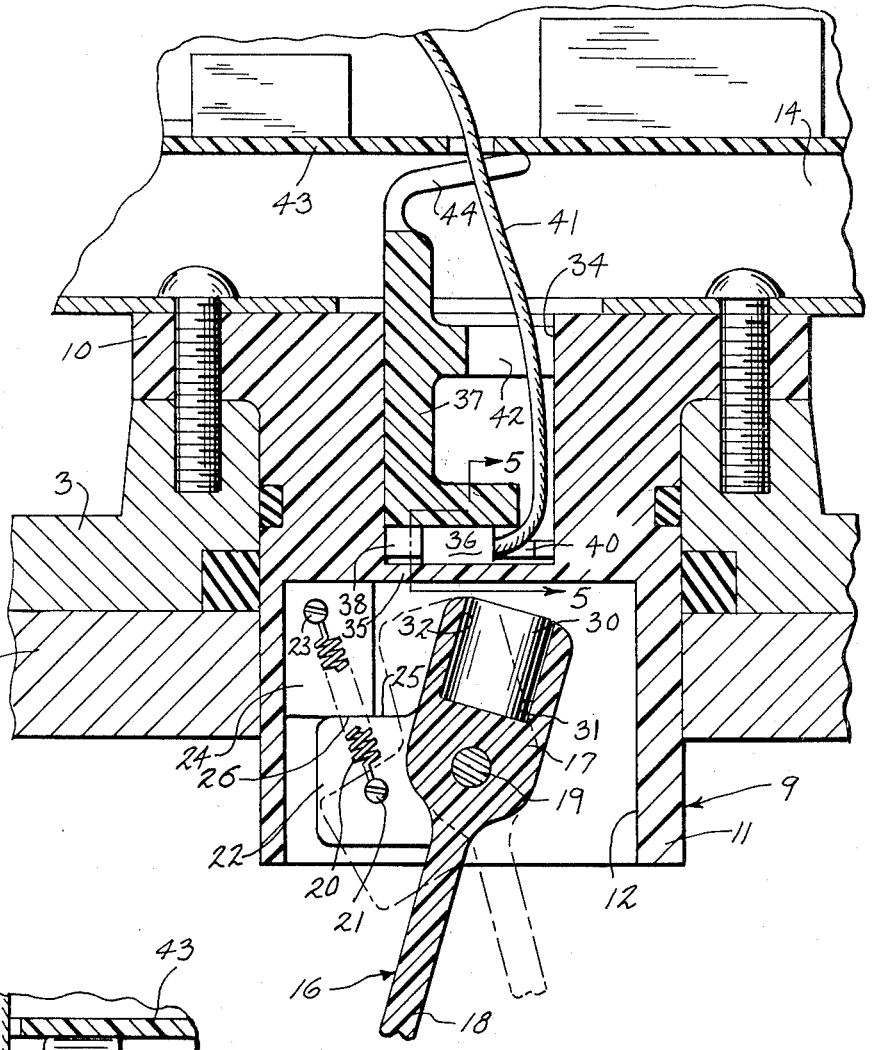
Fig. 4
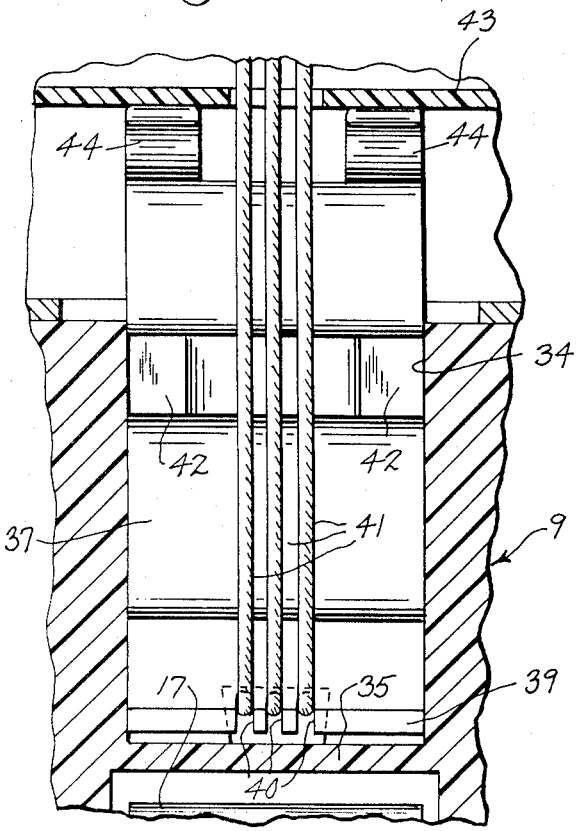
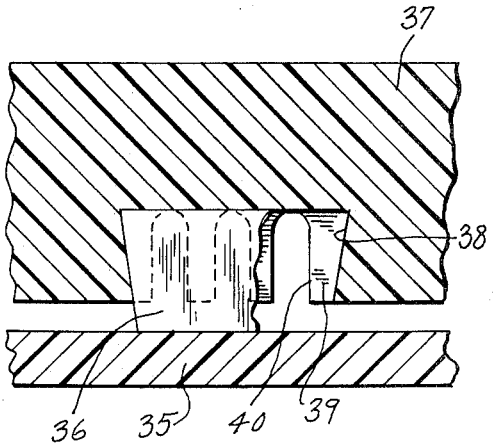
Fig. 5

LIQUID FLOW INDICATOR

BACKGROUND OF THE INVENTION

Flow indicators are frequently installed in water lines, such as automatic sprinkler systems, to provide a signal when the water line is opened, as for example, when a sprinkler head opens or when the water line is ruptured.

In the past, the flow indicators have frequently taken the form of a pivotable paddle or vane which is disposed within the water line. In the conventional type of indicator, the vane is carried by a metal stem that extends through a stuffing gland or seal to the exterior of the indicator. When water flows through the line, the vane and stem are pivoted, and the outer end of the stem acts to trip a switch to actuate an alarm or signal indicating that the water line is open. The stuffing box or seal must be flexible in order to accommodate pivoting movement of the stem and yet under enough tension to prevent leakage at high water pressure. Certain automatic sprinkler systems are designed for a pressure in the range of about 50 psi, while others may be designed for pressures up to 175 psi. Seals are normally designed so that an increase in pressure will increase the sealing effect of the seal, and thus at higher pressures, an increased force is required to pivot the vane and attached shaft that extends through the seal or stuffing box. Thus, in certain situations, where only one or two spinkler heads may be opened, the flow may not be sufficient in a high pressure system to operate the flow indicator.

Over a period of time, the seals age and tend to become hard or brittle and this will change the sensitivity of the indicator, requiring greater water pressure to pivot the vane and generate the signal. Aging of the seal can also promote leakage of the water through the seal.

In an attempt to overcome this problem, it has been proposed in the past to utilize a magnetic switch in which pivoting movement of the vane would actuate the switch to generate the signal or alarm. The U.S. Pat. No. 1,967,017 to Bohner is directed to a flow indicator in which a magnetically susceptible vane, in the static or non-flow position, completes a circuit which is broken when the vane is pivoted by fluid flow within the line.

The U.S. Pat. No. 3,446,986 to Cox describes a magnetically controlled fluid flow indicator utilizing a movable piston which actuates a magnetic switch, while the Hendricks U.S. Pat. No. 1,490,901 discloses a magnetic flow indicator in which the fluid flow moves a sliding core to operate the circuit and generate a signal.

SUMMARY OF THE INVENTION

The invention is directed to an improved liquid flow indicator, having particular use in an automatic sprinkler system, which utilizes a magnetically actuated switch to complete a circuit and generate a signal indicating flow within the liquid line. In accordance with the invention, the indicator is mounted in the water line and includes a plastic vane retainer or support which is disposed in sealed relation within an opening in the wall of the water line. A flexible, one-piece plastic vane is formed with a head that is pivotally connected to the retainer, and the vane is provided with a generally fan-shaped body portion that is located transversely within the water line. The vane is spring biased to a slight angular position in an upstream direction, and if the water line is opened downstream, the water flow will pivot the vane in a downstream direction, causing a magnet, which is mounted within a recess in the head of the vane, to move into proximity with a sensor or magnetic switch that is located within an outer recess in the retainer, to thereby close the switch and generate a signal, indicating water flow within the line.

The vane retainer is formed with a pair of aligned recesses which are in sealed relation, and the head of the vane containing the magnet is located within the inner recess while the sensor is disposed in the outer recess. In the indicator of the invention, there is no moving member that passes through a seal to the exterior, and thus the problem of aging and embrittlement of the seal is avoided and leakage is eliminated.

The plastic vane is sufficiently rigid to maintain its shape under static conditions within the water line, and yet the vane is capable of flexing under conditions of water flow to a position where it is generally parallel to the axis of the water line to minimize restriction to flow. The vane is also sufficiently flexible so that it can be curled or rolled and inserted through the opening into the interior of the water line. After insertion, the vane will spring back to a flat condition.

As the vane is made entirely from plastic material without metal components, the specific gravity of the vane is less than water, so that, in effect, the vane is weightless when mounted in the water line and gravity will not affect its position. As gravity will not affect the vane, it can be mounted horizontally, vertically, or at an angle to the vertical without any change in sensitivity.

As the flow indicator of the invention eliminates the need for a stem or shaft which extends through a packing fland or seal to the exterior, a more uniform sensitivity is achieved at all pressures. The entire vane of the indicator of the invention is exposed to the line pressure, and, therefore, the sensitivity of the indicator will be the same, regardless of whether the system is operating under high pressure or low pressure line conditions.

Other objects and advantages will appear in the course of the following description.

DESCRIPTION OF THE DRAWINGS

The drawings illustrate the best mode presently contemplated of carrying out the invention.

In the drawings:

FIG. 3 is an enlarged fragmentary longitudinal section showing the magnet and sensor;

FIG. 4 is an enlarged fragmentary transverse section showing the holder for the magnetic sensor; and FIG. 5 is a section taken along line 5—5 of FIG. 3.

DESCRIPTION OF THE PREFERRED EMBODIMENT

Figure 1:
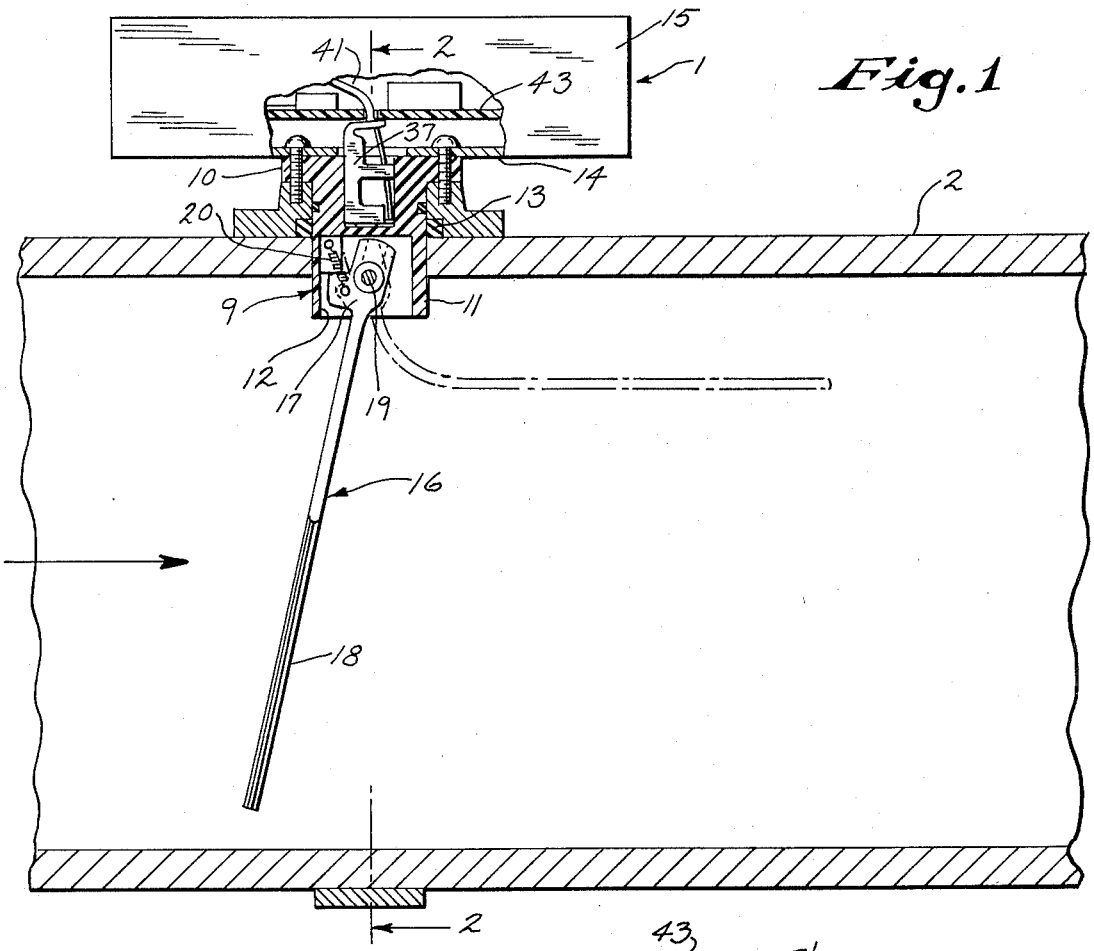
FIG. 1 is a longitudinal section showing the flow indicator of the invention as connected in a liquid line with the vane in the non-flow or static position.

The drawings illustrate a liquid flow indicator 1, such as that to be used in an automatic sprinkler system, which is attached to a water line or pipe 2 upstream of the sprinkler heads. The indicator 1 includes a generally curved saddle 3 which is connected around the water line 2 through a strap 4 and bolts 5. Saddle 3 is provided with an opening 6 which is aligned with an opening 7 in the pipe, and a gasket 8 is mounted within a recess in the saddle and seals the opening 7.

In accordance with the invention, a plastic or non-metallic vane retainer or support 9 is mounted within the openings 6 and 7, and the retainer 9 includes an enlarged head 10 that bears against the outer surface of the saddle 3 and a generally cylindrical body portion 11 that defines an inner recess 12. The retainer 9 is sealed within the opening 6 by an O-ring 13 which is mounted within a peripheral groove in the outer surface of body portion 11.

As shown in FIG. 1, a channel-shaped base plate 14 is mounted against the outer surface of the head 10 by a series of screws and the plate 14 is enclosed by a channel-shaped cover 15.

Figure 2:
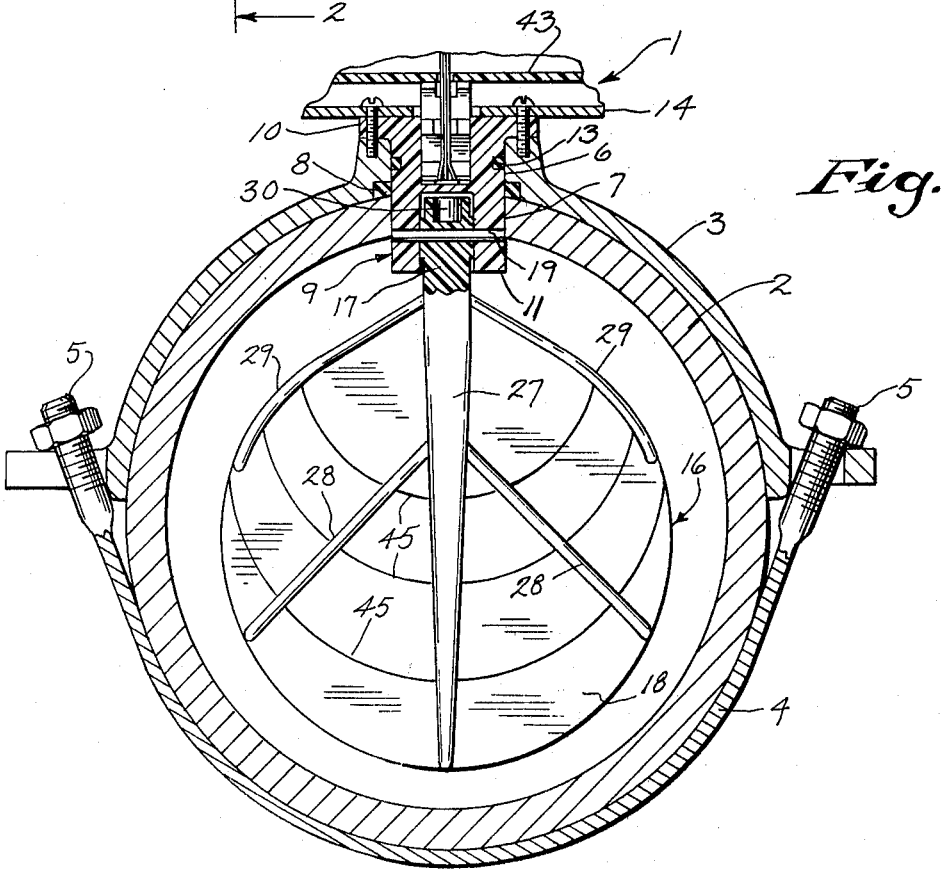
FIG. 2 is a section taken along line 2—2 of FIG. 1.

A flexible, one-piece, plastic vane 16 is positioned within the pipe 2 and is mounted for pivoting movement with respect to the retainer 9. As best shown in FIGS. 2 and 3, the vane 16 is formed with a head 17, and a generally fan-shaped body 18 which is disposed transversely within the water line 2.

To pivot the vane 16 to the retainer 9, a pivot pin 19 extends through an opening in the head 17 and is received within aligned openings in the body portion 11 of the retainer.

The vane 16 is adapted to be biased in an upstream direction by a spring 20. One end of the spring 20 is secured to a pin 21 that extends between lugs 22 on head 17, while the opposite end of the spring is engaged with a pin 23 that is connected to the internal projection 24 in recess 12. With this construction, the force of the spring 20 will urge the vane 16 in an upstream direction, clockwise as shown in FIG. 1, and the pivoting movement is limited by engagement of the outer surface 25 of lugs 22 with the inner surface 26 of the projection 24. With the surfaces 25 and 26 in engagement, the vane will be located at an angle of about 10° with respect to the vertical.

The vane is preferably formed of a plastic material, such as polyethylene, and, as best illustrated in FIG. 2, the body 18 of the vane is provided with a central reinforcing rib 27, a pair of central diagonal ribs 28 and a pair of upper diagonal ribs 29 which extend outwardly from the central rib. The ribs 27–29 do not restrict the vane from being curled into coiled configuration in order for it to be inserted within the openings 6 and 7, and yet, the ribs provide a certain degree of rigidity and aid in keeping the body of the vane in a flat condition after it has been inserted into the pipe 2.

The upper diagonal or sloping ribs 29 serve an added function in that they facilitate removal of the vane from the pipe through the openings 6 and 7. The diagonal edges 29 wedge against the portion of the pipe wall bordering the openings 7 and serve to deform the vane into a configuration where it can be pulled through the opening.

A magnet 30 is mounted within a recess 31 formed in the head 17 of the vane 16. To facilitate insertion of the magnet 30 within the recess 31, the head 17 is provided with a longitudinal groove 32 bordering the recess, and, as the magnet is inserted within the recess, the air is vented through the groove 32. To provide positive positioning of the magnet within the recess 31, the magnet, in practice, is heated before it is inserted into the recess and, on insertion, the heat will melt the plastic material to provide a firm bond between the magnet and the head of the vane.

As shown in FIG. 3, the head 10 of the retainer 9 is formed with a well 34 which is separated from the inner recess 12 by a transverse wall 35. The wall 35 closes off the opening 7 so that there can be no flow of liquid between the recess 12 and well 34.

A sensor or magnetic switch 36 is disposed within the outer well 34 and the sensor is carried by a plastic positioner or bracket 37. As best shown in FIG. 5, the inner surface of the positioner is provided with a dovetail guideway 38, and the sensor 36 has correspondingly dovetailed side walls so that it can slide into the guideway and be positioned against the wall 39, which is located at the end of the guideway 38. The dovetail connection enables the sensor 36 to slide within the guideway 38 but prevents outward displacement of the sensor from the positioner 37.

As shown in FIG. 4, the wall 39 is formed with a series of notches 40 and the three lead wires 41 from the sensor extend through the notches and then pass between the spaced upper arms 42 of the positioner for connection to the electrical circuit which is mounted on a circuit board 43 located within the space between the base plate 14 and the cover 15.

To urge the positioner 37 and sensor 36 downwardly so that the sensor bottoms against the wall 35, the outer end of the positioner is provided with a pair of flexible spring-like arms 44. When the unit is assembled, the board 43 will deform the arms in a direction toward the sensor 36, and the resiliency of the arms will tend to bias the sensor downwardly against the wall 35.

The body 18 of vane 16 can be provided with a series of generally concentric lines or markings 45, as shown in FIG. 2, to enable the body to be cut along the lines to various sizes for use in different diameter water lines.

In operation, under static, no-flow conditions, the force of the spring 20 will urge the vane 16 to a slight angular upstream position, as shown in FIG. 1. When a sprinkler head downstream is opened, or a break or rupture occurs downstream in the water line, the flow of water will act against the face of the body 18 of the vane 16, to pivot the vane rearwardly to the phantom position shown in FIG. 1. Due to the flexible nature of the vane, the vane can be flexed to a position in which it is substantially parallel to the axis of the water line 2, thereby offering minimum restriction to the flow of water through the line. When the line is subsequently closed and the flow of water discontinues, the force of the spring 20 will return the vane 16 to the position shown in FIG. 1, and the ribs 27–29 will insure that the vane is located in a flat condition, generally perpendicular to the axis of the water line.

The flow indicator of the invention eliminates the need for a shaft or other member extending through a stuffing box or seal and thereby eliminates the problems associated with that type of construction.

As the vane is formed entirely of plastic material and has a specific gravity less than water so that gravity will not affect the vane, the flow indicator can be mounted in any desired attitude without any change in sensitivity.

Due to its flexible nature, the vane can be curled or rolled and inserted through the openings 6 and 7 into the water line, and the ribs 27–29 will aid the vane in springing back to a flat condition after it is inserted within the line. If it is necessary to remove the vane from the line 2, the upper diagonal edges 29 will ride against the wall of the pipe bordering the opening and act to wedge the vane into a curled condition so that it can be easily withdrawn through the opening without damage.

While the application has shown the flow indicator as used in a water line for an automatic sprinkler system, it is contemplated that the flow indicator can be used in any type of liquid flow line where it is desired to have an indication of liquid flow.

Various modes of carrying out the invention are contemplated as being within the scope of the following claims particularly pointing out and distinctly claiming the subject matter which is regarded as the invention.

We claim:

1. A water flow indicator for use in an automatic sprinkler system, comprising clamping means to be clamped to the outer surface of a water pipe having an aperture, said clamping means having an opening disposed in alignment with said aperture in said pipe, a vane retainer having a head disposed against the outer surface of the clamping member and having a generally cylindrical stem portion disposed within the aligned opening and aperture, said retainer having an inner axial recess and an outer axial well and a wall separating said recess and said well, a one-piece flexible plastic vane having a head disposed within the recess and pivotally connected to said stem portion and having a generally circular body portion disposed within said pipe, a magnet carried by the head of said vane and disposed on the inner side of said wall, a holder disposed within said well, a sensor carried by the holder and disposed within the well and in contact with said wall, said sensor being connected in an electrical circuit, biasing means for urging the vane to an upstream angular position under non-flow conditions, and a stop on said vane retainer and disposed to be engaged by said vane when said vane is in said upstream angular position, opening of said water pipe downstream causing flow within said pipe to pivot the vane in a downstream direction and thereby move the magnet into proximate relation with said sensor to thereby close the electrical circuit and generate a signal.

2. A fluid flow indicator comprising a vane retainer disposed within an opening in a fluid flow line and having an inner axial recess and an outer axial well separated by a transverse wall, a one-piece flexible plastic vane having a head disposed within the recess and having a generally circular body portion disposed within the fluid flow line, means for pivotally connecting said head to the vane retainer, a magnet carried by the head of said vane and disposed on the inner side of said wall, a holder disposed within said well, magnetic switch means carried by the holder and disposed within the well in contact with said wall, said magnetic switch means being connected in an electrical circuit, and biasing means for urging the magnetic switch means against said wall, opening of said fluid flow line downstream causing flow within said line to pivot the vane in a downstream direction under predetermined flow conditions and thereby move the magnet into proximate relation with said switch means to thereby close the electrical circuit and generate a signal.

3. The indicator of claim 2, wherein said body portion of the vane is provided with a series of spaced concentric markings to enable the vane to be cut to various sizes for use in different size liquid lines.

4. The indicator of claim 2, wherein the inner surface of said holder has a dovetailed guideway receiving said switch means, said switch means having complementary dovetail walls mating with the guideway.

5. The indicator of claim 2, and including a plurality of electrical leads connecting the magnetic switch means and the electrical circuit, and positioning means on said holder for isolating said electrical leads from each other.

6. The indicator of claim 2, wherein said biasing means comprises a flexible arm on said holder, said arm being engaged in a flexed condition with a stationary object to thereby provide a biasing force on said holder to urge the magnetic switch means into contact with said wall.

7. The indicator of claim 2, and including second biasing means for urging the vane to an upstream angular position under non-flow conditions, and stop means disposed to be engaged by said vane for precisely positioning said vane in said upstream angular position.

8. The indicator of claim 2, wherein the cross sectional area of said recess is substantially greater than the cross sectional area of said well.

* * * * *